US010010196B2

(12) United States Patent
Millen

(10) Patent No.: US 10,010,196 B2
(45) Date of Patent: Jul. 3, 2018

(54) APPARATUS FOR HOLDING JEWELRY AND OTHER ARTICLES

(71) Applicant: Pole Vault Storage, LLC, Prosper, TX (US)

(72) Inventor: Maria E. Millen, Prosper, TX (US)

(73) Assignee: POLE VAULT STORAGE, LLC, Prosper, TX (US)

( * ) Notice: Subject to any disclaimer, the term of this patent is extended or adjusted under 35 U.S.C. 154(b) by 0 days.

(21) Appl. No.: 15/098,311

(22) Filed: Apr. 13, 2016

(65) Prior Publication Data

US 2016/0220042 A1 Aug. 4, 2016

Related U.S. Application Data

(63) Continuation-in-part of application No. 14/684,867, filed on Apr. 13, 2015, now abandoned.

(60) Provisional application No. 61/986,252, filed on Apr. 30, 2014.

(51) Int. Cl.

| | |
|---|---|
| ***A47F 7/02*** | (2006.01) |
| ***A47F 7/00*** | (2006.01) |
| ***A47F 5/00*** | (2006.01) |
| ***A47G 29/08*** | (2006.01) |

(52) U.S. Cl.

CPC ..... *A47F 7/02* (2013.01); *A47F 5/0006* (2013.01); *A47G 29/08* (2013.01)

(58) Field of Classification Search

CPC ..... A47F 7/02; A47F 5/0006; A47F 5/0838; A47G 25/74; A47G 29/08; A47G 25/0692; A47G 25/746; A47H 1/08; A47H 1/022; A47H 1/102; A47H 1/142; A47H 1/122; A47H 13/00; A47K 3/38; A47K 2201/02; A47K 10/04; A47B 61/003; A47B 61/02

USPC ..... 211/85.2, 105.3, 123, 85.3, 105.1, 113, 211/87.01, 124, 119, 89.01, 119.009, 211/119.011, 206; 248/326, 333, 248/261–265, 251; 223/85, DIG. 1, 223/DIG. 2, DIG. 4

See application file for complete search history.

(56) References Cited

U.S. PATENT DOCUMENTS

| | | | | | |
|---|---|---|---|---|---|
| 3,633,862 | A * | 1/1972 | Breen | A47H 1/102 | 248/251 |
| 4,909,405 | A * | 3/1990 | Kerr, Jr. | H02G 3/125 | 220/3.2 |
| 5,593,025 | A * | 1/1997 | Feibelman | A47F 7/02 | 206/495 |
| 5,642,595 | A * | 7/1997 | Daniels | A47H 1/02 | 160/330 |
| 5,894,610 | A * | 4/1999 | Winter | A47K 3/38 | 285/46 |

(Continued)

*Primary Examiner* — Hiwot E Tefera

(57) ABSTRACT

A holding apparatus having a first and second support tube that slidably engage each other is provided. Each of the first and second support tubes has an end cap coupled to an end of the respective support tube. The first support tube has a bore and an open end opposite the end cap coupled to the first support tube. The engagement of the first and second support tubes enables a smooth surface on the first support tube so that jewelry or other small articles may be positioned thereon and freely slide back and forth along the surface of the first support tube. The end cap coupled to the second support tube has a bore for receiving the open end of the first support tube at full insertion of the second support tube into the bore of the first support tube.

20 Claims, 11 Drawing Sheets

(56) References Cited

U.S. PATENT DOCUMENTS

| | | | | |
|---|---|---|---|---|
| 6,253,497 | B1 * | 7/2001 | Gekler | A47K 17/024 248/251 |
| 6,260,600 | B1 * | 7/2001 | Miller | A47H 1/08 160/19 |
| 7,631,849 | B2 * | 12/2009 | Chen | F04D 25/088 220/3.9 |
| 8,113,208 | B2 * | 2/2012 | Chaisson | A41D 13/05 128/864 |
| 8,205,760 | B2 * | 6/2012 | Chang | A47H 1/102 211/105.3 |
| 8,651,291 | B1 * | 2/2014 | Prather | A45C 11/16 211/113 |
| 2009/0272866 | A1 * | 11/2009 | Solomovitz Brief | B60R 11/0241 248/276.1 |
| 2012/0285913 | A1 * | 11/2012 | Taurins | A47F 5/0006 211/85.3 |
| 2013/0160273 | A1 * | 6/2013 | Schuetz | A47F 5/0876 29/428 |

* cited by examiner

APPARATUS FOR HOLDING JEWELRY AND OTHER ARTICLES

CROSS-REFERENCE TO RELATED APPLICATIONS

This application is a Continuation-in-Part application of U.S. patent application Ser. No. 14/684,867, filed Apr. 13, 2015, which claims the benefit of U.S. Provisional Application Ser. No. 61/986,252, filed Apr. 30, 2014, which are hereby incorporated by reference in their entirety.

BACKGROUND

This disclosure relates to an apparatus and system for holding and organizing jewelry and/or other articles.

Most conventional jewelry holders are containers that simply provide a cavity, box, or drawer into which the jewelry may be placed. Unfortunately, finding and accessing a jewelry item, especially a matching pair of earrings with the associated retainers, is very difficult when the jewelry is all stored together, particularly in a single cavity. Additionally, viewing the collection of earrings to find a pair which best accessorize the current outfit of the user is also very difficult when the jewelry is all stored and jumbled together. It would be desirable, then, to have a jewelry storage apparatus, which could store earrings as individual pairs, and display the collection.

One attempt to overcome these problems is to arrange items along a rod. However, arranging items such as bangles (solid bracelets which cannot be opened) on a solid rod and/or removing particular ones of these items from the solid rod is challenging for the user. For example, to remove a particular item (e.g., a bangle) that is surrounded by other items requires all of the items to be removed from the solid rod in order to access the bangle. Other attempts to overcome the problem is to compartmentalize a jewelry container. However, the compartments tend to be quite large in order to be versatile enough to hold various sized pieces of jewelry, such as a decorative pin, bracelet, necklace, ring, or pair of earrings in a compartment. Consequently, numerous items of jewelry, especially smaller items such as earrings, are stored in a single compartment. In addition, placing multiple jewelry items in each compartment causes the jewelry items to strike each other, as well as becoming tangled therein. It would be desirable, then, to have a jewelry storage and display apparatus, which avoids tangling of the jewelry, as well as making the items easy to extract without disturbing their organization. In general, this has not been achieved in any known jewelry or small article storage means. It is seen, then, that there exists a need for an apparatus which will be particularly suitable for holding earrings, bangles, and other jewelry items both for display and storage that will avoid tangling of the jewelry items while maintaining a separation of one earring of a pair of earrings from the other earring of the pair during storage, and will enable the user to view substantially all of the contents of the container. Further, it is desirable if such an apparatus is also adaptable to holding and displaying other articles such as belts, rolls of tape, small clothing items, tools, and the like.

SUMMARY

In one aspect, a holding apparatus is provided. The holding apparatus includes a first support tube having a first bore and an open end. A first end cap is coupled to the first support tube opposite the open end. The holding apparatus also includes a second support tube slidably inserted into the first bore through the open end of the first support tube. A second end cap is coupled to said second support tube. The second end cap includes a second bore configured to receive the open end of the first support tube such that a transition area between the first support tube and the second support tube at the open end is enclosed in the second bore.

In another aspect, a jewelry holding system is provided. The jewelry holding system includes a holding apparatus having a first support tube and a second support tube coupled in telescoping configuration to each other for movement to an extended and separable position for receiving one or more articles. The first and second support tubes are disposed in end-to-end relation to each other. The first and second support tubes also move to a retracted position in which the second support tube is fully inserted into the first support tube. An end cap is coupled to one of the first and second support tubes. The end cap includes a mounting hole configured for receiving an end portion of a support hanger for releaseably coupling thereto. The support hanger is coupled to a support structure. The jewelry holding system also includes a small accessory storage component slidably coupled to an outer surface of the first support tube.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings.

DETAILED DESCRIPTION

Referring to the figures, embodiments of the disclosure provide a system and apparatus for holding jewelry and/or other articles for display and storage while facilitating avoiding tangling of the jewelry, maintaining separation of the jewelry and other articles, for example, a bangle or a pair of earrings separated from other jewelry, and enabling a user to view substantially all of the jewelry and/or other articles at once. In some embodiments, an apparatus includes a first support having a bore and a second support sized to be slidably insertable into the bore of the first support. When the apparatus is in use for display and/or storage of the jewelry and/or other articles, the second support is fully inserted into the bore of the first support such that a transition area from an outer surface of the second support to an outer surface of the first support is not visible. This enables the apparatus to present a smooth outer surface to enable the supported jewelry and/or other articles to be moved along the first support such that they are not impeded by the transition area from sliding along the first support.

Additionally, in other embodiments, the apparatus may include a small accessory storage component. The small accessory storage component enables display and storage of small accessories; for example, earrings, pins, and/or brooches. The small accessory storage component includes a plurality of apertures for receiving, for example, wires and/or pins of earrings and/or brooches. In one embodiment, the small accessory storage component is flexible to facilitate receiving a pin and/or brooch clasp through at least one aperture of the small accessory component.

Although generally described herein with respect to an apparatus for displaying and storing jewelry, the apparatus, systems, and/or methods described are applicable to an apparatus or device that may display and store any type or form of article and/or household item, for example, cooking utensils, cordage, tools, hats, camping gear, clothing accessories, spools of various materials (e.g., tape, thread, filament, and other flexible materials), various types of gear and/or tackle (e.g., collars, leashes, reins, bridles, etc.), and the like. Thus, it is contemplated that the apparatus and/or systems described herein may be easily scaled smaller or larger and strengthened to accommodate larger items.

Figure 1:
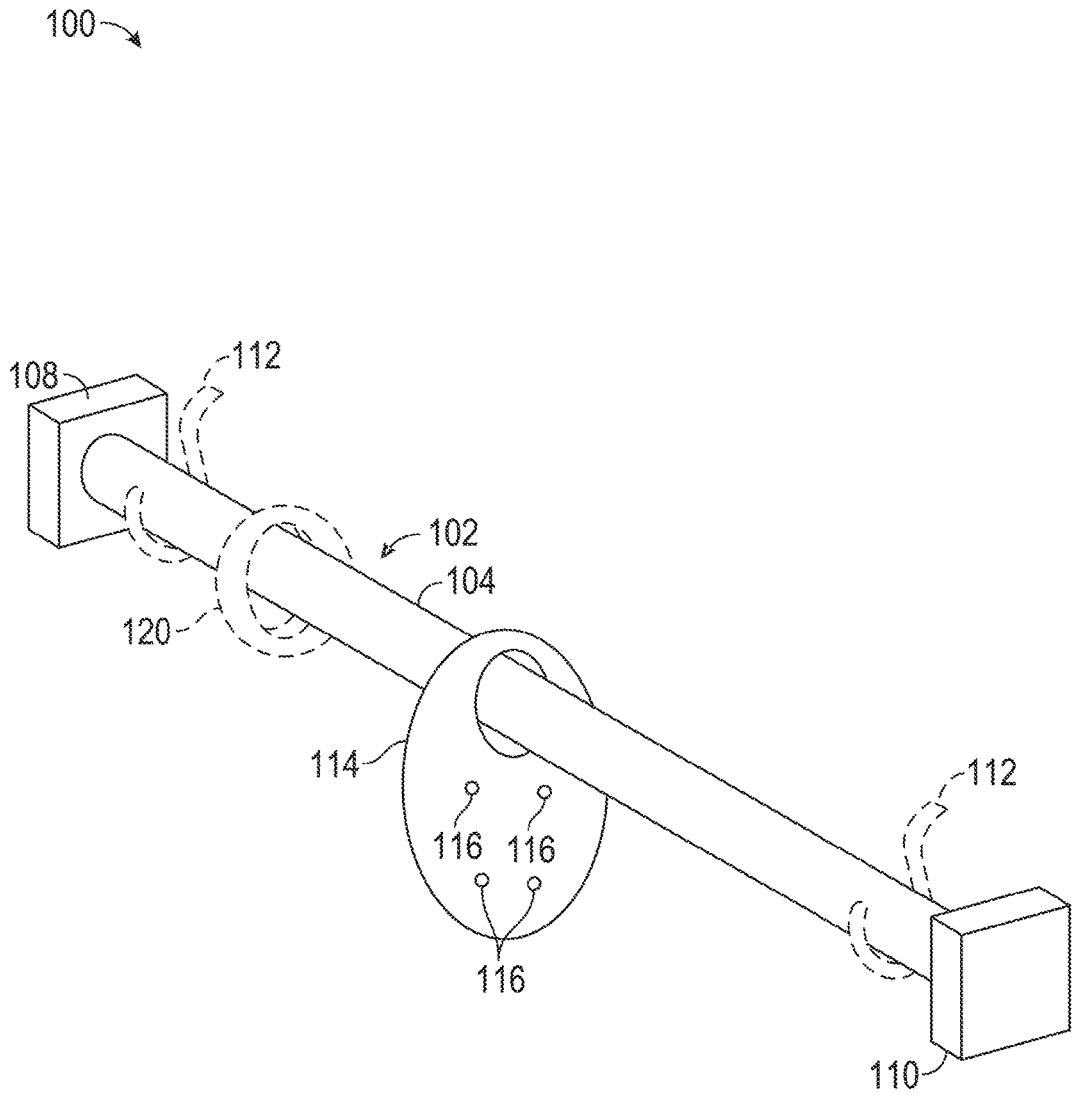
FIG. 1 is a schematic perspective view of one embodiment of an exemplary jewelry holding system.

FIG. 1 is a schematic perspective view of one embodiment of an exemplary jewelry holding system 100. In the illustrated embodiment, the jewelry holding system 100 includes a holding apparatus 102 configured for holding jewelry and/or other articles, such as bracelets. The holding apparatus 102 includes a first support tube 104 slidably coupled to a second support tube (not shown in FIG. 1) forming a nesting or telescoping configuration. Coupled to ends of the holding apparatus 102 are first and second end caps, 108 and 110, respectively. In the exemplary embodiment, the end caps 108 and 110 are square in shape. In other embodiments, the end caps 108 and 110 may be any shape that enables the jewelry holding system 100 to function as described herein. The end caps 108 and 110 are sized and shaped to facilitate spacing the first support tube 104 a predetermined distance from, for example, a mounting surface that the jewelry holding system 100 may be coupled to. For example, the jewelry holding system 100 may be releaseably attached to support hangers 112, such as wall hooks, for supporting the jewelry holding system 100 on a wall, display rack, or the like.

In the exemplary embodiment, the jewelry holding system 100 includes a small accessory storage component 114 slidably coupled to the holding apparatus 102. The small accessory storage component 114, discussed in more detail below, is shown fitting over the first support tube 104 of the holding apparatus 102 and hanging therefrom. In one embodiment, the small accessory storage component 114 preferably has apertures or holes 116 and 140 formed therethrough. The apertures 116 and 140 are sized for receiving, for example, mounting components such as wires, hooks, or screws typically part of small items, such as earrings. In addition, the small accessory storage component 114 includes a mounting hole (illustrated in FIG. 6A) sized and shaped to fit over the first support tube 104 of the holding apparatus 102. It is contemplated that the small accessory storage component 114 may be omitted from the jewelry holding system 100, in some embodiments.

Figure 2:
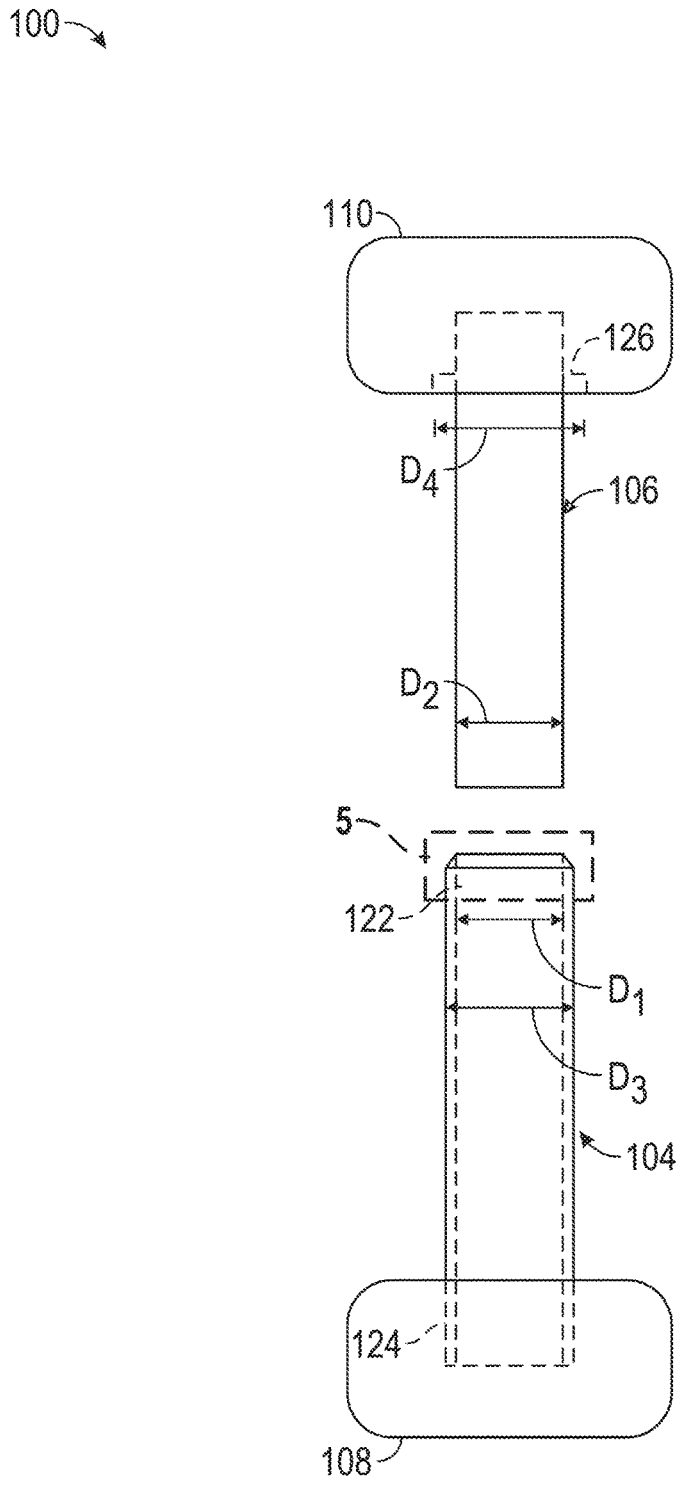
FIG. 2 is a schematic plan view of a holding apparatus shown in FIG. 1, illustrating the holding apparatus in an open position.

FIG. 2 is a schematic plan view of the holding apparatus 102 shown in FIG. 1, illustrating the holding apparatus 102 in the open position. The relative cross-sections of the first support tube 104 and a second support tube 106 are exaggerated for clarity. In the illustrated embodiment, the first support tube 104 includes a bore 122 formed therethrough. The bore 122 is sized and shaped to receive the second support tube 106. More specifically, the bore 122 has a diameter $D_1$ sufficiently large to snuggly fit over an outer diameter $D_2$ of the second support tube 106 to enable a snug, sliding fit between the first and second support tubes 104 and 106. While the first support tube 104 and the second support tube 106 are described as having circular cross-sections (i.e., having diameter measures), it is contemplated that one or more of the support tubes 104 and 106 may be multi-faceted, for example, square, hexagonal, octagonal, and the like, in cross-section and the bore 122 accordingly to effectively center the second support tube 106. In other embodiments, the support tubes 104 and 106 may have any cross-section that enables the second support tube 106 to snuggly, slidably fit within the bore 122 of the first support tube 104.

In the exemplary embodiment, the support tubes 104 and 106 are fabricated from polyvinyl chloride (PVC). In other embodiments, the support tubes 104 and 106 may be fabricated from any material that enables the holding apparatus 102 to function as described herein, for example, plastic, metal, or wood.

The first support tube 104 is coupled to the first end cap 108. For example, in some embodiments, the first support tube 104 may be compression fitted into an opening 124 of the first end cap 108, and/or secured with an adhesive, a tape, or a mechanical fastener. Alternatively, the first support tube 104 and first end cap are molded as one piece. More specifically, the opening 124 is sized to provide a friction fit with an end portion of the first support tube 104. In addition, the second support tube 106 is coupled to the second end cap 110. For example, in some embodiments, the second support tube 106 may be compression fitted into an opening 126 of the second end cap 110, and/or secured with an adhesive, a tape, or a mechanical fastener. Likewise, the second support tube 106 and second end cap 110 are, in some examples, molded as one piece. More specifically, the opening 126 is sized to provide a friction fit with an end portion of the second support tube 106. In addition to enabling spacing the first support tube 104 a predetermined distance from, for example, a mounting surface as described herein, the end caps 108 and 110 facilitate ease of manipulation of the jewelry holding system 100, and securely holding the jewelry holding system 100 on the support hangers 112 shown in FIG. 1.

Figure 3:
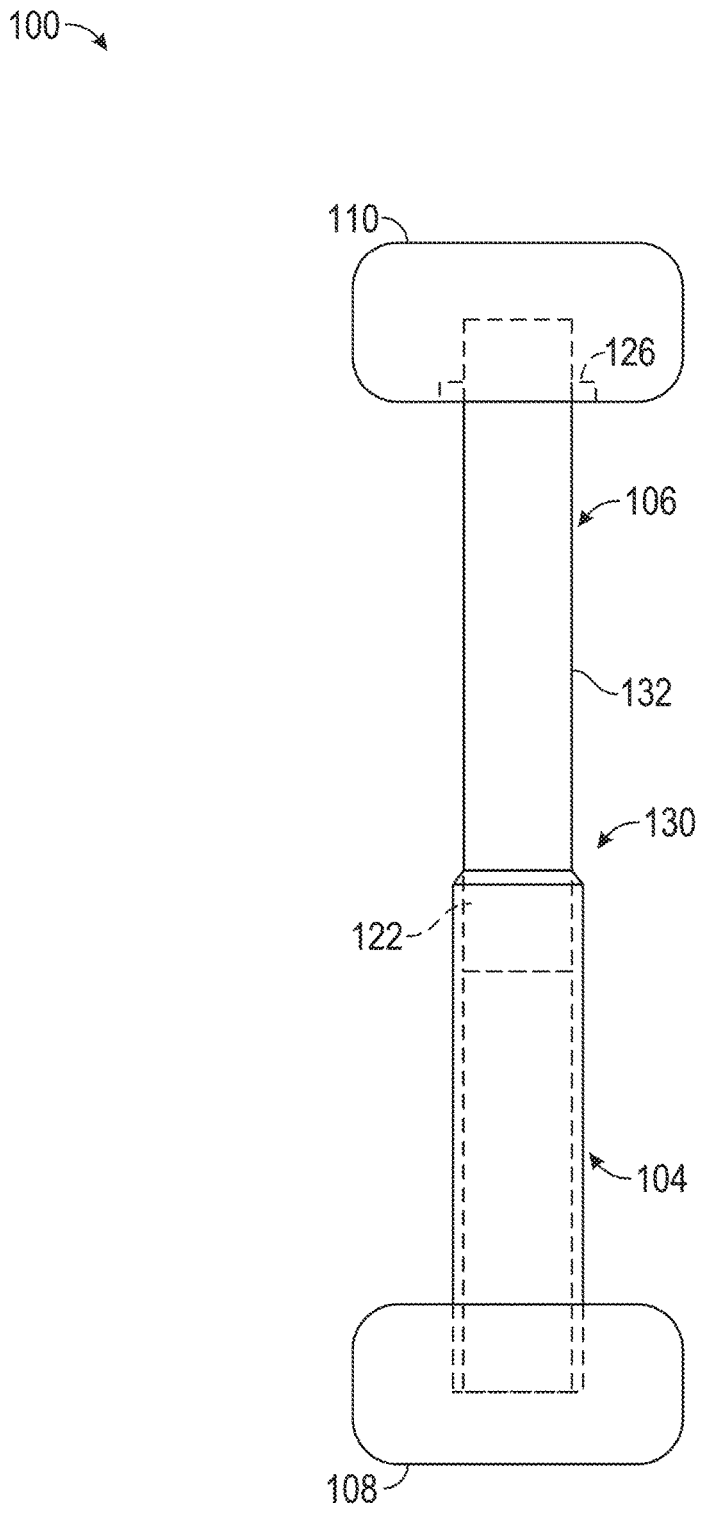
FIG. 3 is a schematic plan view of the holding apparatus shown in FIG. 2, illustrating a second support tube inserted into a bore of a first support tube.

FIG. 3 is a schematic plan view of the holding apparatus 102 shown in FIG. 2, illustrating the second support tube 106 inserted into the bore 122 of the first support tube 104.

Figure 4:
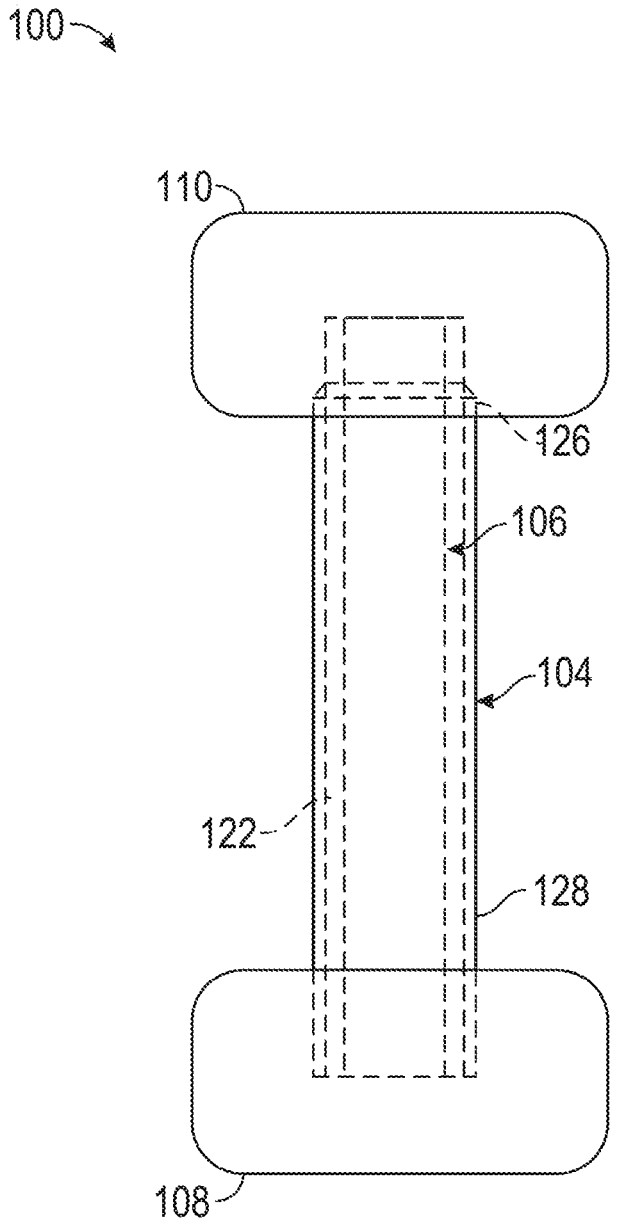
FIG. 4 is a schematic plan view of the holding apparatus shown in FIG. 3 in a fully assembled position, such that the first support tube and the second support tube are fully engaged or compressed.

FIG. 4 is a schematic plan view of the holding apparatus 102 shown in FIG. 3 in a fully assembled position, such that the first support tube 104 and the second support tube 106 are fully engaged or compressed. As shown in FIG. 4, in some embodiments, a portion of the opening 126 in the second end cap 110 is sized to receive at least a portion (e.g., a transition area 130 shown in FIG. 3) of the first support tube 104 and at least a portion of the second support tube 106. More specifically, the opening 126 is formed as a counter-bore to enable the first support tube 104 and the second support tube 106 to fully engage such that no part of the second support tube 106 is visible or accessible outside of the first support tube 104. In one embodiment, the opening 126 includes a portion that has a diameter $D_4$ (shown in FIG. 2) sufficiently large to fit over an outer diameter $D_3$ (shown in FIG. 2) of the first support tube 104 to enable a clearance fit between the first support tube 104 and the second end cap 110. This enables the holding apparatus 102 to be moved freely between the open position illustrated in FIG. 2 and the fully assembled position shown in FIG. 4.

In another embodiment, the diameter $D_4$ portion of the opening 126 is formed sufficiently large to fit over an outer diameter $D_3$ (shown in FIG. 2) of the first support tube 104 to enable a snug, friction fit between the first support tube 104 and the second end cap 110. Providing a snug, friction fit enables the holding apparatus 102 to be held in the fully assembled position shown in FIG. 4. To move the holding apparatus 102 to the open position illustrated in FIG. 2, the user may apply an axial force to separate or release the first support tube 104 from the second end cap 110 of the holding apparatus 102. In other embodiments, the holding apparatus 102 may include an internal locking mechanism, for example an internal twist-lock mechanism (not shown), to facilitate holding the holding apparatus 102 in the fully assembled position shown in FIG. 4.

The fully assembled position shown in FIG. 4 enables the holding apparatus 102 to present a continuous outer surface 128 of the first support tube 104 to the user for displaying and/or storing jewelry. An advantage of presenting the continuous outer surface 128 to the user is that jewelry and/or other articles displayed or stored on the holding apparatus 102 may slide freely along the outer surface 128 without being impeded by the transition area 130 (shown in FIG. 3) from the outer surface 128 of the first support tube 104 to an outer surface 132 (shown in FIG. 3) of the second support tube 106 where the first support tube 104 and the second support tube 106 meet. If the second support tube 106 is not fully inserted into the first support tube 104, as shown in FIG. 4, the transition area 130 may catch or impede sliding of jewelry and/or other articles along the holding apparatus 102.

In operation, the second support tube 106 is slid out of the bore 122 of the first support tube 104, thus presenting the holding apparatus 102 in the open position illustrated in FIG. 2. The user may position jewelry (e.g., bracelets, necklaces, and the like) and/or other articles along the first support tube 104 and/or the second support tube 106 of the holding apparatus 102. For example, the article 120 (shown in FIG. 1) and one or more small accessory storage components 114 (shown in FIG. 1) may be placed or deployed along the holding apparatus 102 when it is assembled. In the exemplary embodiment, the holding apparatus 102 provides a way of neatly arranging various items (e.g., article 120 and also the small accessory storage component 114) so that the various items may be easily applied or removed from the holding apparatus 102.

After placing one or more of the articles 120, and/or the small accessory storage components 114, along the first support tube 104 and/or the second support tube 106 of the holding apparatus 102, the second support tube 106 is reinserted into the bore 122 of the first support tube 104. In some embodiments, all of the various items (e.g., the articles 120, the small accessory storage components 114, etc.) which are supported on the holding apparatus 102 may be slid toward first end cap 108, the side away from the bore 122 of the first support tube 104, before removing the second support tube 106. This facilitates reducing and/or eliminating the need to remove any of the various items before adding a new item to the holding apparatus 102. In some embodiments, the various items may be divided between the first support tube 104 and the second support tube 106 before moving the holding apparatus 102 to the open position shown in FIG. 2, to enable the user to insert additional items and/or remove items from between two items positioned on the holding apparatus 102.

As described herein, the outer surface 128 of the first support tube 104 is a continuous, smooth surface free of projections and/or holes. This enables easily sliding the various items along a length of the first support tube 104 and/or the second support tube 106 of the holding apparatus 102. After positioning the holding apparatus 102 in the fully assembled position illustrated in FIG. 4, the holding apparatus 102 may be releaseably attached to the support hangers 112, such as walls hooks, proximate the end caps 108 and 110 for supporting the holding apparatus 102 on a wall, display rack, or the like. The holding apparatus 102 is rigid enough that it requires no intermediate support. It is understood that the holding apparatus 102 need not be moved to the open position in all circumstances when placing various items onto the holding apparatus 102. For example, some items may facilitate engagement with the holding apparatus 102 without opening the holding apparatus 102, such as items that can be opened/closed and/or items that provide a means for hanging from the holding apparatus 102.

Although FIG. 4 illustrates an embodiment wherein the support tubes 104 and 106 nest within the end caps 108 and 110, or otherwise are seated within the end caps 108 and 110, other embodiments are contemplated. As an example, the support tubes 104 and 106 may be attached to the end caps 104 and 106, at an exterior point. Alternatively, the support tubes 104 and 106 and end caps 108 and 110 are manufactured, milled, produced or otherwise fabricated as individual units. In some examples, the support tubes 104 and 106, while still nesting, do not protrude into the end caps 108 and 110.

Figure 5:
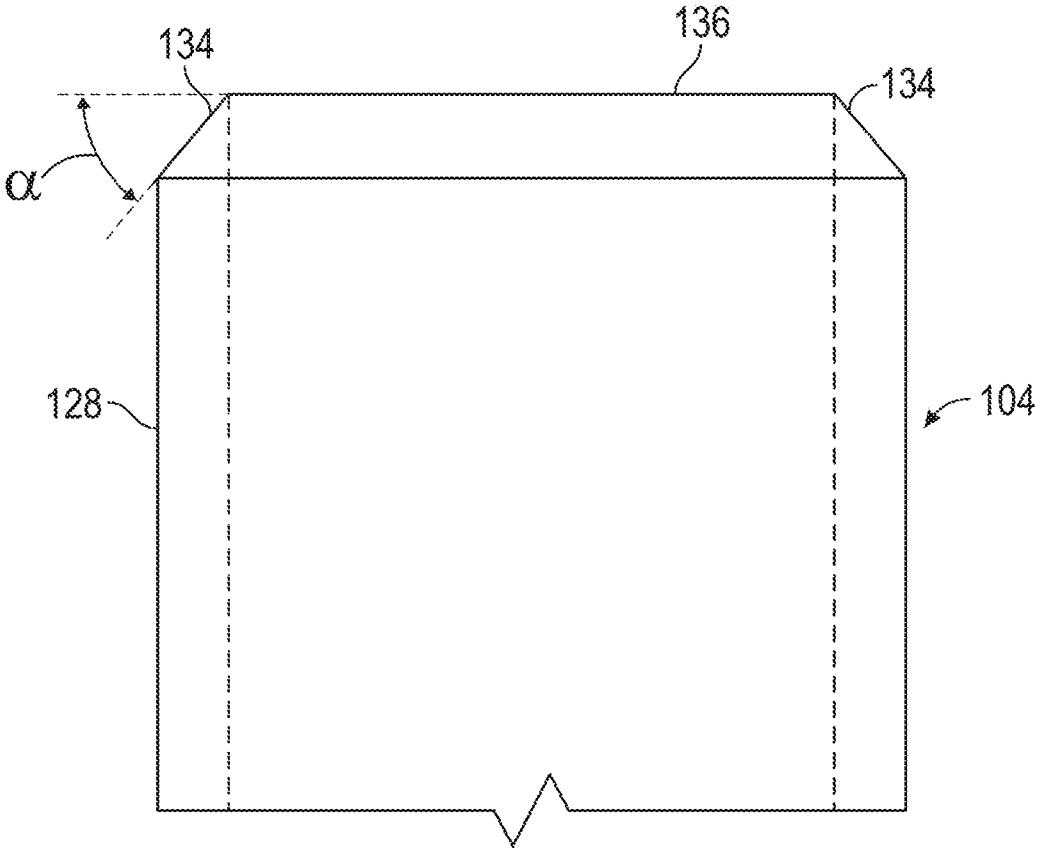
FIG. 5 is an enlarged view taken from FIG. 2 of an end portion of the first support tube.

FIG. 5 is an enlarged view of an end portion of the first support tube 104 taken from FIG. 2. In the illustrated embodiment, the end portion of the first support tube 104 includes a chamfer 134 (e.g., transition area 130) on its outer surface 128, having a flat contour. The chamfer 134 of the outer surface 128 of the first support tube 104 is fabricated in a substantially flat surface such that it extends outward at an angle $\alpha$ from an area where it contacts the bore 122 to an area where it intersects the outer surface 128. In some embodiments, the angle $\alpha$ is approximately 45° from a line coincident with an end edge 136 of the first support tube 104, which means that it is also approximately 45° from a line extending substantially axially along the outer surface 128 of the first support tube 104. The chamfer 134 provides a smooth transition from the outer surface 132 of the second support tube 106 to the outer surface 128 of the first support tube 104, so there are no sharp edges to impede sliding of the jewelry and/or other articles along the holding apparatus 102. In some embodiments, the angle α is within a range between and including approximately 15° and approximately 75°, and more specifically, within a range between and including approximately 30° and approximately 60° from a line coincident with an end edge 136. Although illustrated with a chamfer 134, in some examples the support tubes 104 and 106 do not include a transition area 130. Both embodiments are contemplated.

Figure 6A:
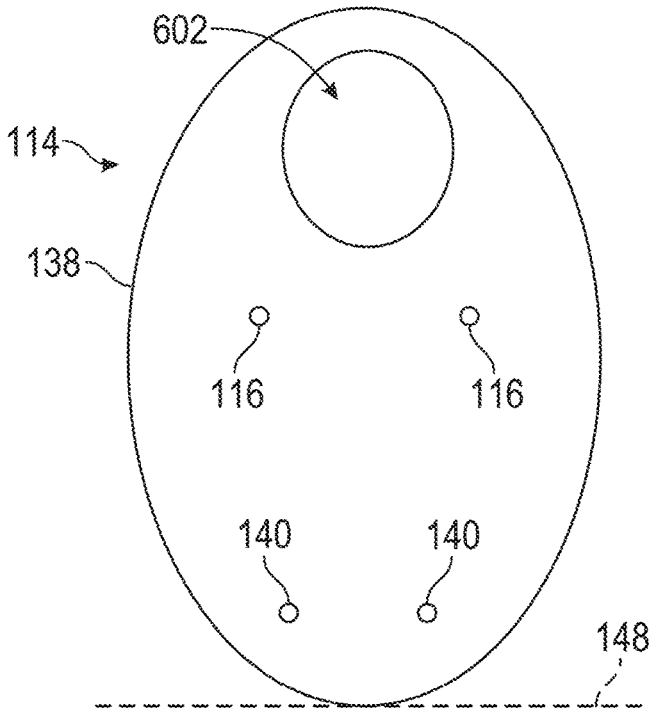
FIG. 6A is a schematic front view of a small accessory storage component shown in FIG. 1.
Figure 6B:
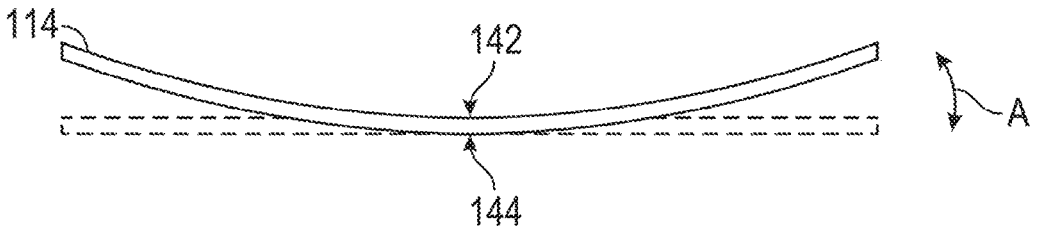
FIG. 6B is a schematic top view of the small accessory storage component shown in FIG. 6A.

FIG. 6A is a schematic front view of the small accessory storage component 114 shown in FIG. 1. FIG. 6B is a schematic top view of the small accessory storage component 114 shown in FIG. 6A. In the exemplary embodiment, the small accessory storage component 114 is configured for holding small pieces of jewelry and other small articles (e.g., earrings, brooches, and the like). The small accessory storage component 114 includes the mounting hole 602 sized and shaped to fit over the first support tube 104 of the holding apparatus 102 and to slide freely thereon. The small accessory storage component 114 also includes a plurality of apertures or holes 116 and 140 extending therethrough. The holes 116 and 140 are sized for receiving, for example, mounting components such as wires, hooks, or screws typically part of small items, such as earrings. While the small accessory storage component 114 is shown in FIG. 6A as having a substantially oval outer perimeter, any shape that enables the small accessory storage component 114 to function as described herein may be used. The small accessory storage component 114 slidably fits over the first support tube 104, via the hole 602, without any extra tie or holder.

In the exemplary embodiment, the apertures 116 and 140 are spaced apart from one another on the small accessory storage component 114 to facilitate grouping small jewelry pieces, such as earrings, and aiding quick retrieval of the small jewelry pieces. For example, the spacing of the apertures 116 and 140 may be predetermined to facilitate positioning dangle and/or drop earrings proximate to each other for storage and/or display, or may be positioned and spaced to enable hoop-style earrings to wrap around the small accessory storage component 114.

In some examples, the small accessory storage component 114 measures 2 and ⅜ inches at a widest portion, and 3 and ⅜ inches at a longest portion. In this example, the apertures 116 and 140 are spaced to accommodate earrings with post backs and non-post backs (e.g. latch backs, French backs, lever backs, etc.). In addition, the apertures 116 and 140 are close enough to an outer perimeter 138 of the small accessory storage component 114 to permit opening and closing the latches without damaging the earrings. In some examples, lower apertures 140 are no more than ⅝ of an inch from a plane of a bottom of the oval perimeter of the small accessory storage component 114, when measured from a bottom-most portion of the small accessory storage component 114. In addition, upper apertures 116 are ½ inch from the plane of a further-most edge of the small accessory storage component 114. In other examples, the apertures 116 and 140 are positioned differently, in some examples more widely, to accommodate brooches.

Referring to FIG. 6B, the small accessory storage component 114 is fabricated from a sufficiently pliable material to enable the small accessory storage component 114 to flex from a substantially planar configuration to a curved configuration as indicated by arrow A. For example, in one embodiment, the small accessory storage component 114 is fabricated from a polystyrene sheet material having a thickness in the range between and including approximately 0.050 inches (in.) and approximately 0.025 in. enabling the small accessory storage component 114 to flex to a curved shape to facilitate attaching pins and/or brooches that include a longer stiff pin or clasp. For example, the pin and/or clasp of an example brooch may be inserted into one of the apertures 116 and 140 of the small accessory storage component 114, extending from a front face 142 of the small accessory storage component 114 to a rear face 144 of the small accessory storage component 114. The small accessory storage component 114 may be flexed to enable the pin and/or clasp to then be inserted through another one of the apertures 116 and 140, thereby enabling the pin and/or clasp of the brooch to be closed, securing the brooch to the small accessory storage component 114.

Figure 7:
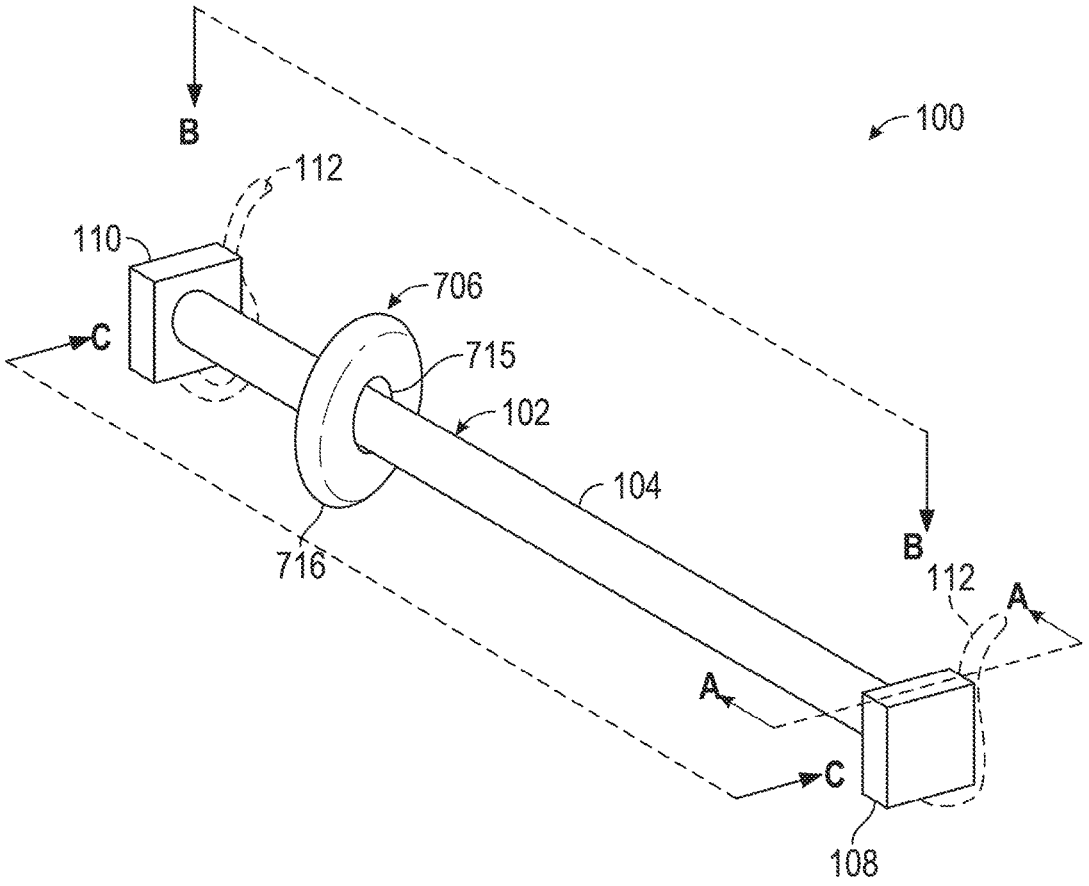
FIG. 7 is a schematic perspective view of one embodiment of an exemplary jewelry holding system.

FIG. 7 is a schematic perspective view of one embodiment of an exemplary jewelry holding system 100. Section lines A-A, B-B, and C-C are identified to provide the perspective for FIGS. 9, 10, and 11, respectively.

Figure 8:
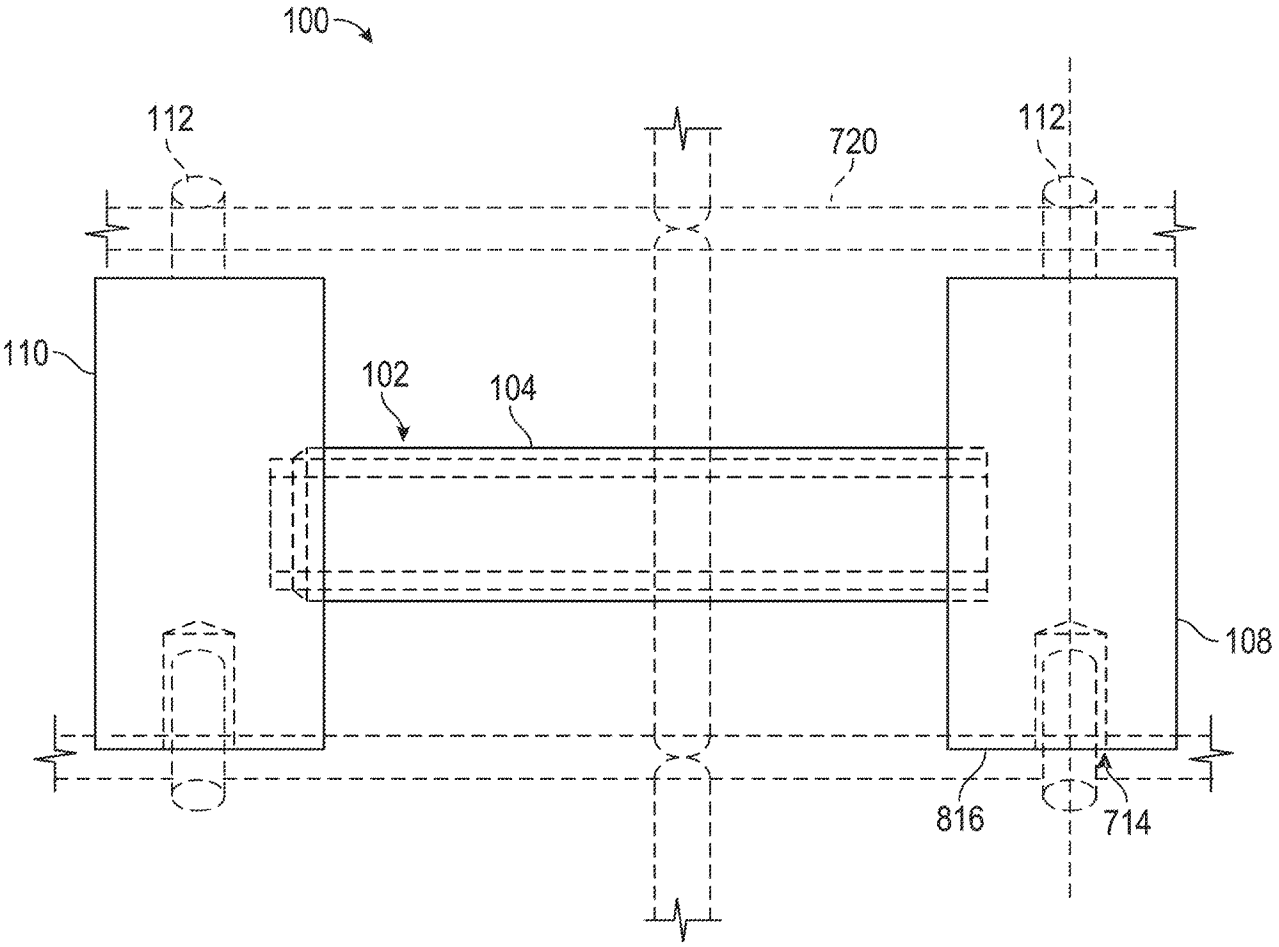
FIG. 8 is a schematic plan view of a holding apparatus shown in FIG. 7 in a fully assembled position.

FIG. 8 is a schematic plan view of a holding apparatus 102 shown in FIG. 7 in a fully assembled position, such that the first support tube 104 and a second support tube (not shown) are fully engaged or compressed, taken about section line C-C.

Figure 9:
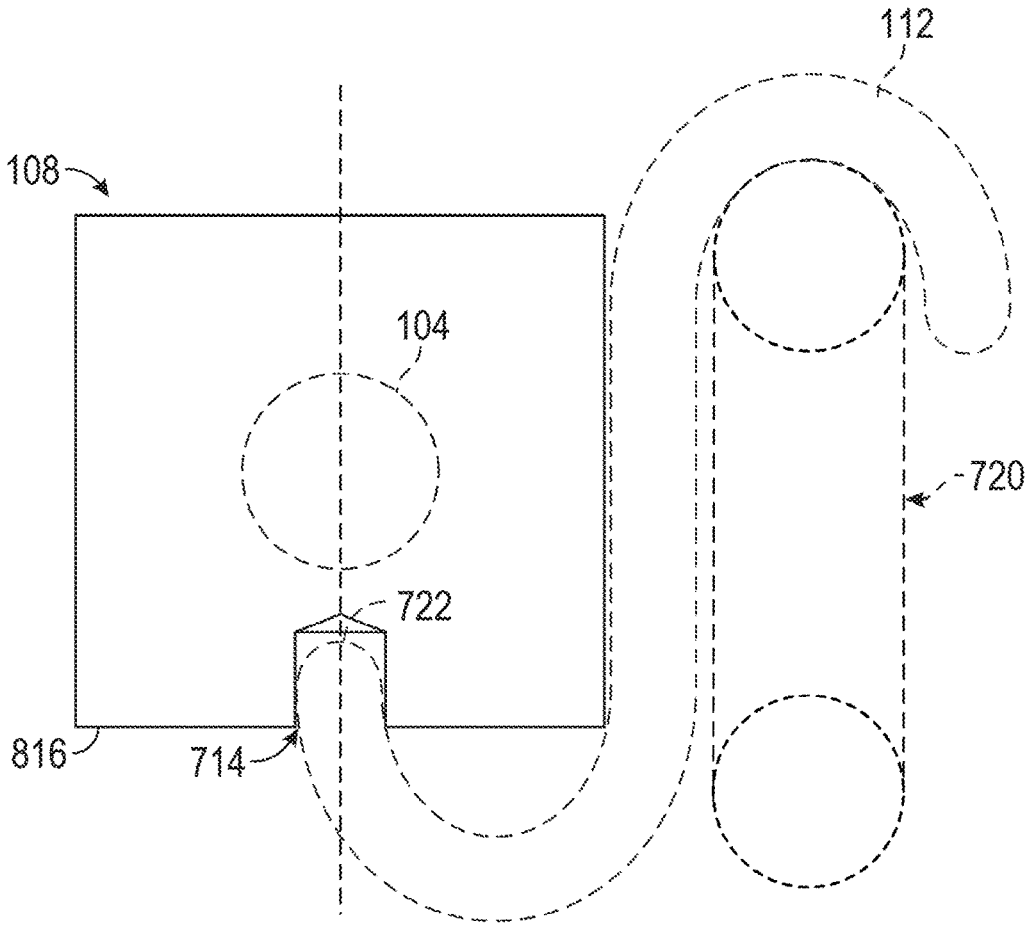
FIG. 9 is a schematic cross-section of the jewelry holding system shown in FIG. 7, taken about section line A-A.

FIG. 9 is a schematic cross-section of the jewelry holding system 100 shown in FIG. 7, taken about section line A-A. In the illustrated embodiment, the jewelry holding system 100 includes the holding apparatus 102 configured for holding jewelry and/or other articles. The holding apparatus 102 includes a first support tube 104 slidably coupled to a second support tube (not shown) forming a nested or telescoping configuration. Coupled to the ends of the holding apparatus 102 are first and second end caps, 108 and 110, respectively. In the exemplary embodiment, the first and second end caps 108 and 110 are square in shape. In other embodiments, the first and second end caps 108 and 110 may be any shape that enables the jewelry holding system 100 to function as described herein. The first and second end caps 108 and 110 are sized and shaped to facilitate spacing the first support tube 104 a predetermined distance from, for example, a mounting structure and/or surface that the jewelry holding system 100 may be coupled to. For example, the jewelry holding system 100 may be releaseably coupled to support hangers 112, which in one embodiment, are releaseably coupled to a display rack 720 shown in FIG. 8.

In the exemplary embodiment, the first and second end caps 108 and 110 include a mounting hole 714 formed in a bottom surface 816 of the end caps 108 and 110. FIG. 8 illustrates the details of first end cap 108; however, the mounting hole of second end cap 110 is formed substantially identically to the mounting hole 714 of the first end cap 108, and thus the second end cap 110 is not discussed in detail herein to reduce redundancy and to facilitate clarity.

Figure 10:
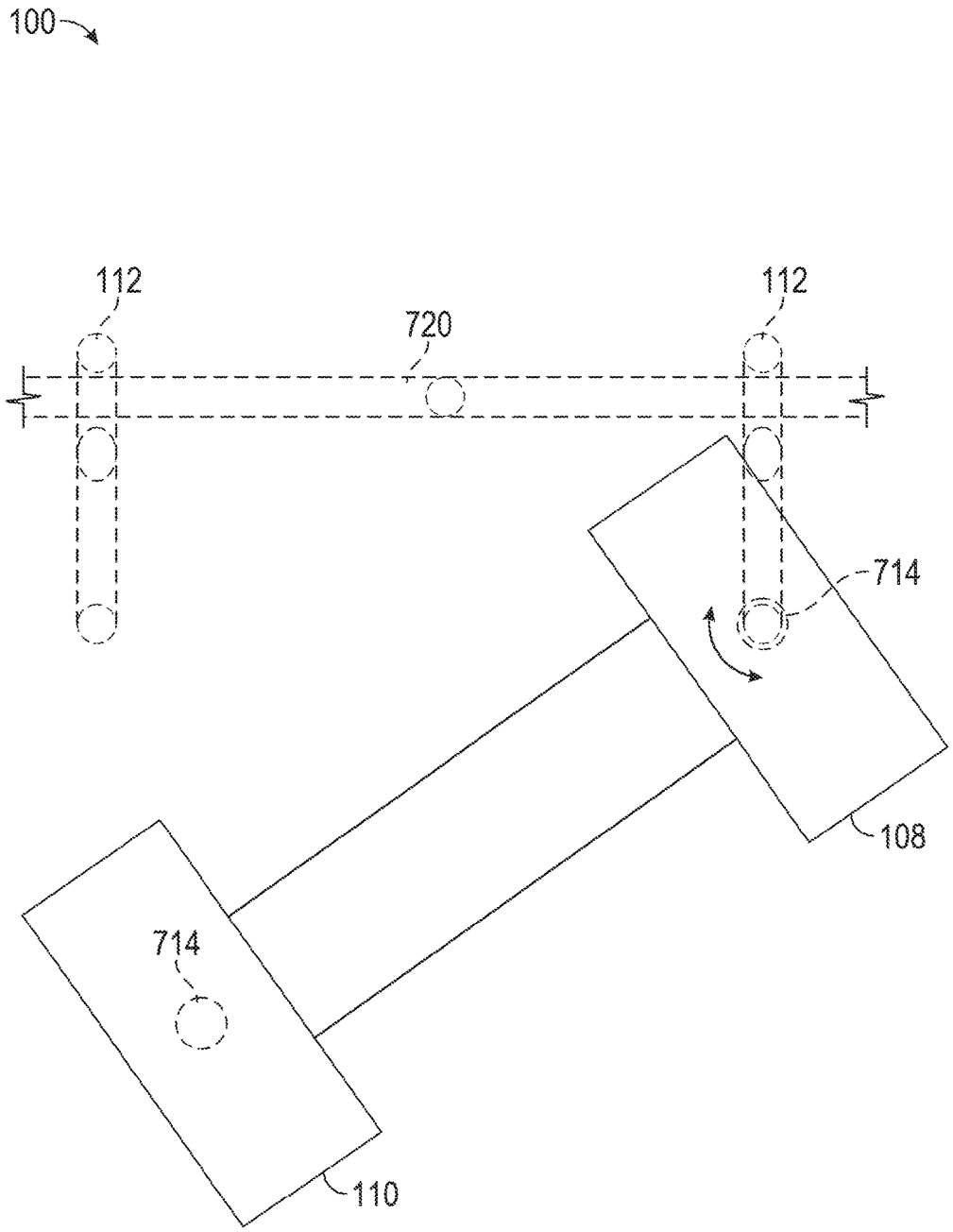
FIG. 10 is a schematic top view of the holding apparatus shown in FIG. 7 illustrating the holding apparatus rotated about an axis defined by an end portion of a support hanger, taken about section line B-B.

With reference to FIGS. 8 and 9, in the exemplary embodiment, first end cap 108 includes the mounting hole 714 formed in a bottom surface 816 of the first end cap 108. The mounting hole is positioned substantially along a centerline of the first end cap with respect to a side of the first end cap 108 as illustrated in FIG. 9, and a front of the first end cap 108 as illustrated in FIG. 8. The mounting hole 714 in the first end cap 108 is sized for receiving, for example, at least an end portion 722 of the support hanger 112. More specifically, the mounting hole 714 is formed as a bore that is sufficiently large to fit over the end portion 722 of the support hanger 112 to enable a clearance fit between the first end cap 108 and the end portion 722 of the support hanger 112. This enables the holding apparatus 102 to be pivoted or rotated about an axis defined by the end portion 722 of the support hanger 112, such that an opposite end of the holding apparatus 102 may be moved freely away from the mounting surface and/or the other support hanger 112, as is illustrated in FIG. 10. In the example of FIG. 10, the system is viewed from above, about line section B-B as illustrated in FIG. 7. Thus the holding apparatus 102 is seen to swing or rotate on the vertical access parallel to the mounting hole 714.

Figure 11:
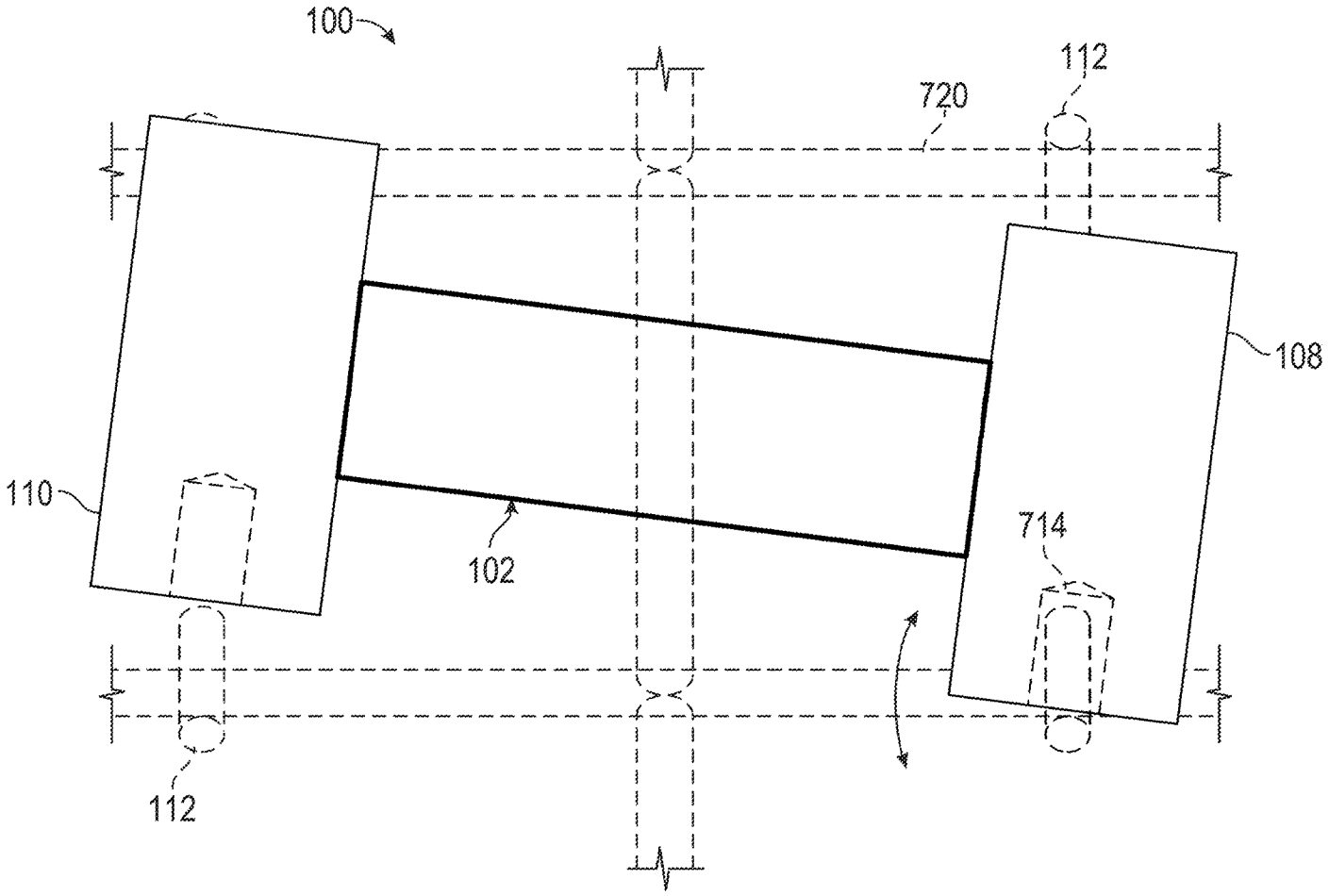
FIG. 11 is a schematic front view of the holding apparatus shown in FIG. 7 illustrating the holding apparatus lifted away from an end portion of a support hanger, taken about section line C-C.

Furthermore, the mounting hole 714 is formed sufficiently large, such that in combination with the length of the holding apparatus 102, the opposite end of the holding apparatus 102 may be moved freely to lift the second end cap 110 away from the other support hanger 112, as illustrated in FIG. 11. The example of FIG. 11 is illustrated from the perspective of viewing the holding apparatus 102 from the front or back (e.g., from the perspective of a user facing the holding apparatus 102, with the holding apparatus 102 parallel to the horizon while not in use, or tilted at an angle to the horizon as illustrated, when in use), about section line C-C as illustrated in FIG. 7. Thus, the mounting hole 714 is formed such that the first end cap 108 may rotate about an axis of the end portion 722 of the support hanger 112, and pitched or pivoted about the end portion 722 of the support hanger 112 similar to a ball-and-socket connection, thereby providing three rotation degrees of freedom. In other embodiments, the first end cap 108 freely rotates or pivots around the end portion 722 of the support hanger but only in one degree of freedom, similar to a hinge. In that embodiment, the end portion 722 of the support hanger 112 beneath the second end cap 110 is retractable, able to be withdrawn, or moved in and out of place. In some examples, there is no end portion 722 beneath the second end cap 110, and instead the second end cap is otherwise secured or locked into place. Alternative embodiments are contemplated. As an example, although ball-and-socket and hinge connections are contemplated, the system 100 also hangs on the support hangers 112, without requiring any additional connections.

Referring back to FIG. 7, in the exemplary embodiment, the jewelry holding system 100 includes a spacer, bumper, or stopper component 706 slidably coupled to the holding apparatus 102. The stopper component 706 is shown fitting over the first support tube 104 of the holding apparatus 102 and hanging therefrom. In one embodiment, the stopper component 706 includes a mounting hole 715 sized and shaped to fit over the first support tube 104 of the holding apparatus 102. It is contemplated that the stopper component 706 may be omitted from the jewelry holding system 100, in some embodiments.

The stopper component 706 is configured for separating articles mounted on the holding apparatus 102 from each other, and/or providing a barrier or stop adjacent one of the first or second end caps 108 and 110 to facilitate preventing an item having a large mounting hole from slipping off the holding apparatus 102. For example, in some embodiments, the holding apparatus 102 may include spools of various materials, where the spools have a large inner diameter that may enable a spool to pass over the end caps 108 or 110. The mounting hole 715 of the stopper component 706, however is sized such that it cannot fit over the end caps 108 and 110. An outer perimeter 716 of the stopper component 706 is sized and shaped to prevent an item, such as a spool from passing over the stopper component 706. Thus, the stopper component 706 facilitates maintaining articles with large inner openings from falling off of the holding apparatus 102.

While the stopper component 706 is shown in FIG. 7 as having a substantially circular outer perimeter 716, any shape that enables the stopper component 706 to function as described herein may be used. The stopper component 706 slidably fits over the first support tube 104, via the mounting hole 715, without any extra tie or holder.

In some embodiments, the stopper component 706 is fabricated from a substantially rigid material. For example, the stopper component 706 may be fabricated from a plastic, wood, or metal material, and may have a material thickness in the range between and including approximately 0.065 inches (in.) and approximately 0.045 in. In other embodiments, the stopper component 706 may be fabricated from a sufficiently pliable material to enable the stopper component 706 to flex and/or bend from a substantially planar configuration to a curved configuration. For example, in one embodiment, the stopper component 706 is fabricated from a polystyrene sheet material in the range between approximately 0.045 in. and approximately 0.025 in., inclusively. Alternatively, the stopper component 706 may be fabricated from any material and have any thickness that enables the stopper component 706 to function as described herein.

The examples illustrated and described herein, as well as examples not specifically described herein but within the scope of aspects of the disclosure, constitute exemplary means for holding and organizing jewelry and/or other articles. For example, some embodiments include the holding apparatus 102 having the small accessory storage component 114 slidably coupled thereto. The small accessory storage component 114 may be fabricated from a substantially pliable material to facilitate storing and/or displaying jewelry and/or other articles.

Advantageously, the jewelry holding system 100 presents to a user a continuous outer surface of the holding apparatus 102 to facilitate having jewelry and/or other articles displayed or stored on the holding apparatus 102 to slide freely along the outer surface without being impeded by a transition from an outer surface of the first support tube to an outer surface of the second support tube where the first support tube and the second support tube meet.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

What is claimed is:

1. A holding apparatus comprising:

a first support tube comprising a first bore and an open end;

a first end cap coupled to said first support tube opposite said open end, said first end cap comprising a mounting hole configured for receiving an end portion of a support hanger;

a second support tube slidably inserted in said first bore through said open end of said first support tube; and a second end cap coupled to said second support tube, said second end cap comprising a second bore configured to receive said open end of said first support tube such that a transition area between said first support tube and said second support tube at said open end is enclosed in said second bore, wherein said second bore of said second end cap is sized to provide a friction fit with said open end of said first support tube; and wherein the first end cap rotates around the end portion of the support hanger only in one degree of freedom; or wherein said mounting hole is formed as a third bore sized to enable said first end cap to move with three degrees of rotation freedom while releaseably coupled to said end portion of the support hanger.

2. The holding apparatus of claim 1, wherein said first support tube further comprises a chamfer formed proximate said open end, and wherein said second bore is configured to receive said chamfer such that said chamfer is enclosed in said second bore.

3. The holding apparatus of claim 1, wherein said second bore of said second end cap is sized to provide a clearance fit with said open end of said first support tube.

4. The holding apparatus of claim 1 further comprising a small accessory storage component slidably coupled to an outer surface of said first support tube.

5. The holding apparatus of claim 4, wherein said small accessory storage component comprises: a mounting hole sized to slidably engage said outer surface of said first support tube, and a plurality of apertures for receiving and holding one or more articles.

6. The holding apparatus of claim 4, wherein said small accessory storage component is fabricated from a pliable material, said small accessory storage component moveable between a first configuration wherein said small accessory storage component is substantially planar, and a second configuration wherein said small accessory storage component is substantially curved.

7. The holding apparatus of claim 6, wherein said small accessory storage component is fabricated from a polystyrene sheet material.

8. The holding apparatus of claim 6, wherein said small accessory storage component has a thickness in a range between and including approximately 0.050 inches and approximately 0.025 inches.

9. The holding apparatus of claim 1, wherein said first support tube and said second support tube are fabricated from polyvinyl chloride (PVC).

10. The holding apparatus of claim 1, further comprising a stopper component slidably coupled to an outer surface of said first support tube, said stopper component comprising a second mounting hole sized to slide along an entire length of an outer surface of said first support tube.

11. A jewelry holding system comprising:

a holding apparatus comprising:

a first support tube and a second support tube coupled in telescoping configuration to each other for movement between an extended and separable position for receiving one or more articles in which said first and second support tubes are disposed in end-to-end relation to each other, and a retracted position in which said second support tube is fully inserted into said first support tube; and a first end cap coupled to said first support tube, said first end cap comprising a mounting hole configured for receiving an end portion of a support hanger for releaseably coupling thereto, wherein said support hanger is coupled to a support structure;

a second end cap coupled to said second support tube, said second end cap comprising a bore configured to receive an open end of said first support tube such that a transition area between said first support tube and said second support tube at said open end is enclosed in said bore, wherein said bore of said second end cap is sized to provide a friction fit with said open end of said first support tube; and a small accessory storage component slidably coupled to an outer surface of said first support tube; and wherein the first end cap rotates around the end portion of the support hanger only in one degree of freedom; or wherein said mounting hole is formed as a second bore sized to enable said first end cap to move with three degrees of rotation freedom while releaseably coupled to said end portion of the support hanger.

12. The jewelry holding system of claim 11, wherein said mounting hole sized to enable a clearance fit between said first end cap and said end portion of said support hanger.

13. The jewelry holding system of claim 11, wherein said first support tube comprises a chamfer formed proximate said open end.

14. The jewelry holding system of claim 11, wherein said small accessory storage component comprises: a mounting second hole sized to slidably engage said outer surface of said first support tube, and a plurality of apertures for receiving and holding one or more articles.

15. The jewelry holding system of claim 11, wherein said small accessory storage component is fabricated from a pliable material, said small accessory storage component moveable between a first configuration wherein said small accessory storage component is substantially planar, and a second configuration wherein said small accessory storage component is substantially curved.

16. The jewelry holding system of claim 15, wherein said small accessory storage component is fabricated from a polystyrene sheet material.

17. The jewelry holding system of claim 15, wherein said small accessory storage component has a thickness in a range between and including approximately 0.050 inches and approximately 0.025 inches.

18. The jewelry holding system of claim 11, wherein said first support tube and said second support tube are fabricated from polyvinyl chloride (PVC).

19. The jewelry holding system of claim 11 further comprising a stopper component slidably coupled to said outer surface of said first support tube, said stopper component comprising a second mounting hole sized to slide along an entire length of an outer surface of said first support tube.

20. The jewelry holding system of claim 11, wherein said first support tube further comprises a chamfer formed proximate said open end, and wherein said bore is configured to receive said chamfer such that said chamfer is enclosed in said bore.

* * * * *